US012501951B2

(12) United States Patent
Taylor

(10) Patent No.: US 12,501,951 B2
(45) Date of Patent: Dec. 23, 2025

(54) SEPARABLE PLAY-CALL WRISTBAND SYSTEM

(71) Applicant: Phillip Taylor, Lithia, FL (US)

(72) Inventor: Phillip Taylor, Lithia, FL (US)

( * ) Notice: Subject to any disclaimer, the term of this patent is extended or adjusted under 35 U.S.C. 154(b) by 0 days.

(21) Appl. No.: 18/736,924

(22) Filed: Jun. 7, 2024

(65) Prior Publication Data

US 2024/0407487 A1 Dec. 12, 2024

Related U.S. Application Data

(60) Provisional application No. 63/506,965, filed on Jun. 8, 2023.

(51) Int. Cl.
*A63B 71/06* (2006.01)
*A41D 20/00* (2006.01)

(52) U.S. Cl.
CPC ..... *A41D 20/00* (2013.01)

(58) Field of Classification Search
CPC ..... A41D 20/00; A63B 2071/0663; A63B 2209/10; A63B 2243/007; A63B 71/06
See application file for complete search history.

(56) References Cited

U.S. PATENT DOCUMENTS

| | | | | |
|---|---|---|---|---|
| 7,041,032 | B1 * | 5/2006 | Calvano | A63B 26/00 482/148 |
| 11,986,718 | B2 * | 5/2024 | Blythe | A41D 20/00 |
| 2010/0080388 | A1 * | 4/2010 | Daniel | A63B 71/06 345/55 |
| 2011/0167536 | A1 * | 7/2011 | Kellerhals | A45C 1/04 224/267 |
| 2015/0135405 | A1 * | 5/2015 | Rothschild | A41D 13/08 2/170 |
| 2016/0135522 | A1 * | 5/2016 | Rothschild | A41D 20/00 2/170 |
| 2017/0065872 | A1 * | 3/2017 | Kelley | G16H 20/30 |
| 2023/0218972 | A1 * | 7/2023 | Blythe | A63B 71/0619 473/422 |

* cited by examiner

*Primary Examiner* — Tajash D Patel
(74) *Attorney, Agent, or Firm* — Dunlap Bennett & Ludwig PLLC

(57) ABSTRACT

A wristband play-call system includes a wristband with one or more wristband connection points along an external surface of the wristband. The wristband play-call system further provides an insert display a space for receiving and retaining an insert between a first surface and a second surface of the insert display. The first surface has a transparent layer, and the second surface has a one or more display connection points configured to removably associate with the one or more wristband connection points. Whereby the insert display can be selectively removed from the wristband.

14 Claims, 4 Drawing Sheets

SEPARABLE PLAY-CALL WRISTBAND SYSTEM

CROSS-REFERENCE TO RELATED APPLICATION

This application claims the benefit of priority of U.S. provisional application No. 63/506,965, filed Jun. 8, 2023, the contents of which are herein incorporated by reference.

BACKGROUND OF THE INVENTION

The present invention relates to sports accessories and, more particularly, a separable play-call wristband system.

A play calling system in sports is the specific language and methods used to call offensive plays. A play caller, say, the quarterback in American football, frequently will wear a sheet of play calls on their wristband, aptly named a "play-call wristband", to reference in the huddle and/or before running the play.

Prior art play-call wristbands provide a wristband and a play-call sheet that are inseparable. It is made up of a sweatband (wristband) integrated with a clear insert display, wherein play-call sheets are inserted for the athlete to reference during games. After the game, the play-call wristband needs to be cleaned to remove odors and kill germs prior to the next use. Being inseparable, current play-call wristbands need to be washed in their entirety, after removing all the insertable play-call sheets. This is very time-consuming because one must not only remove all the play-call sheets in the plastic but also re-insert them prior to their subsequent use. Also, the dryer can cause the plastic of the clear insert display to melt and become sticky and distorted, making them very hard to clean and, in turn, more and more difficult to read through each subsequent use.

SUMMARY OF THE INVENTION

In one aspect of the present invention, a wristband play-call system includes a wristband having one or more wristband connection points along an external surface of the wristband; and an insert display sleeve having a transparent layer and a connection layer, wherein the transparent layer and the connection layer are joined to define open end for receiving end an insert between the transparent layer and the connection layer whereby play-call indicia provided by the insert is visible through the transparent layer, wherein the connection layer has a one or more display connection points configured to removably connect with the one or more wristband connection points.

In another aspect of the present invention, the wristband play-call system further includes wherein the transparent layer and the connection layer are substantially coextensive and align when joined, wherein opposite said open end is a closed end, wherein the connection layer has a first surface facing the transparent layer and a second surface facing away from the transparent layer, and the one or more display connection points are only on the second surface, wherein the wristband has an external surface comprising a first half and a second half, wherein the one or more wristband connection points is a singular wristband connection area that covers at least three-fourths of the first half of the external surface, wherein the one or more display connection points is a singular display connection area substantially coextensive with the singular wristband connection area, and wherein the one or more display and wristband connection points are hook and loop fasteners or snaps.

In the wristband play-call system further includes wherein the transparent layer and the connection layer are pivotable joined along a shared edge so that the transparent layer is movable between an open position for receiving the insert and a closed position for retaining the insert, wherein the transparent layer and the connection layer are joined along three shared edges so as to provide one open end for receiving the insert, wherein the connection layer has a first surface facing the transparent layer and a second surface facing away from the transparent layer, and the one or more display connection points are only on the second surface, wherein the wristband is a sleeve having an external surface comprising a first half and a second half, wherein the one or more wristband connection points is a singular wristband connection area that covers at least three-fourths of the first half of the external surface, wherein the one or more display connection points is a singular display connection area substantially coextensive with the singular wristband connection area; further including complementary fasteners on the transparent layer and the connection layer that are dimensioned and disposed to form a locked engagement in the closed position; a connection pocket and associated pocket opening along the first surface of the connection layer; and a transparent pocket and associated pocket opening along an inward surface of the transparent layer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a wristband play-call system providing a wristband with one or more wristband connection points along an external surface thereof. The wristband play-call system provides an insert display defining a space for receiving and retaining an insert therein wherein the insert display has a transparent layer through which the insert is substantially visible therethrough. The insert display screen provides one or more display connection points configured to removably connect with the one or more wristband connection points. As a result, the insert display can be selectively removed from the wristband when needed; for example, when a user just wants to wash the wristband and not the insert display.

Figure 1:
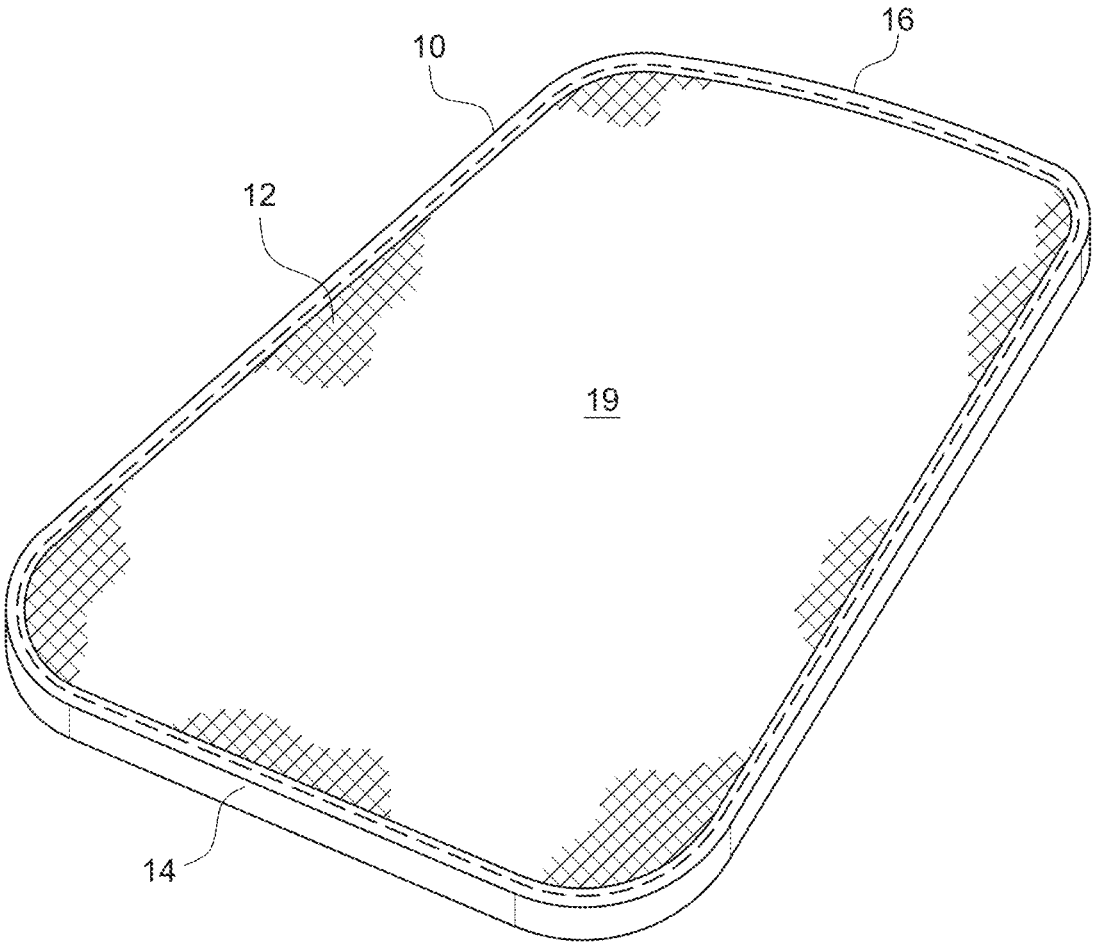
FIG. 1 is a bottom perspective view of an exemplary embodiment of a clear insert display portion of the present invention in a separated condition relative to the assembled apparatus, illustrating the display connection area along a lower surface of the clear insert is visible.
Figure 2:
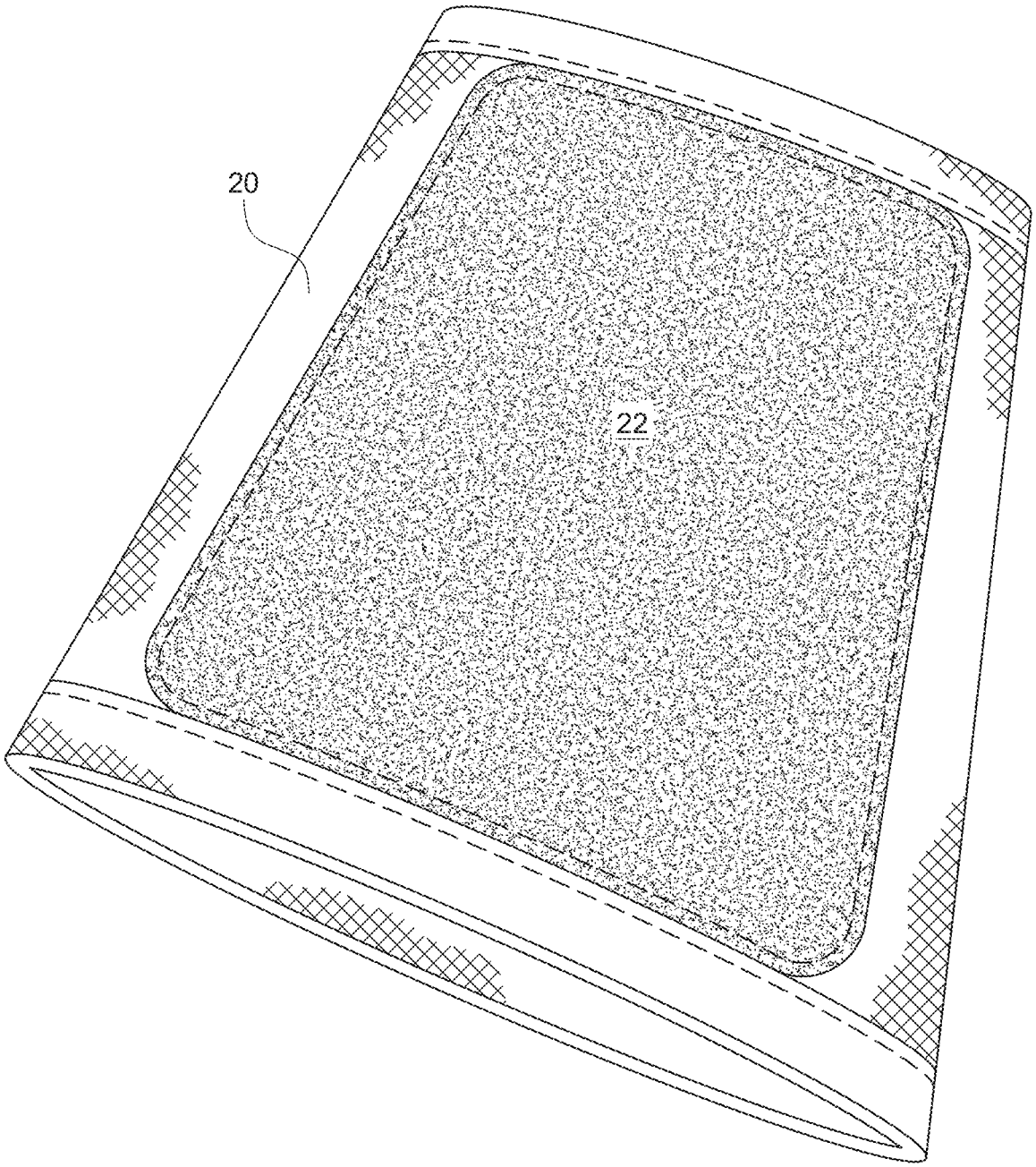
FIG. 2 is a top perspective view of an exemplary embodiment of a wristband portion of the present invention in the separated condition, illustrating a wristband connection area.
Figure 3:
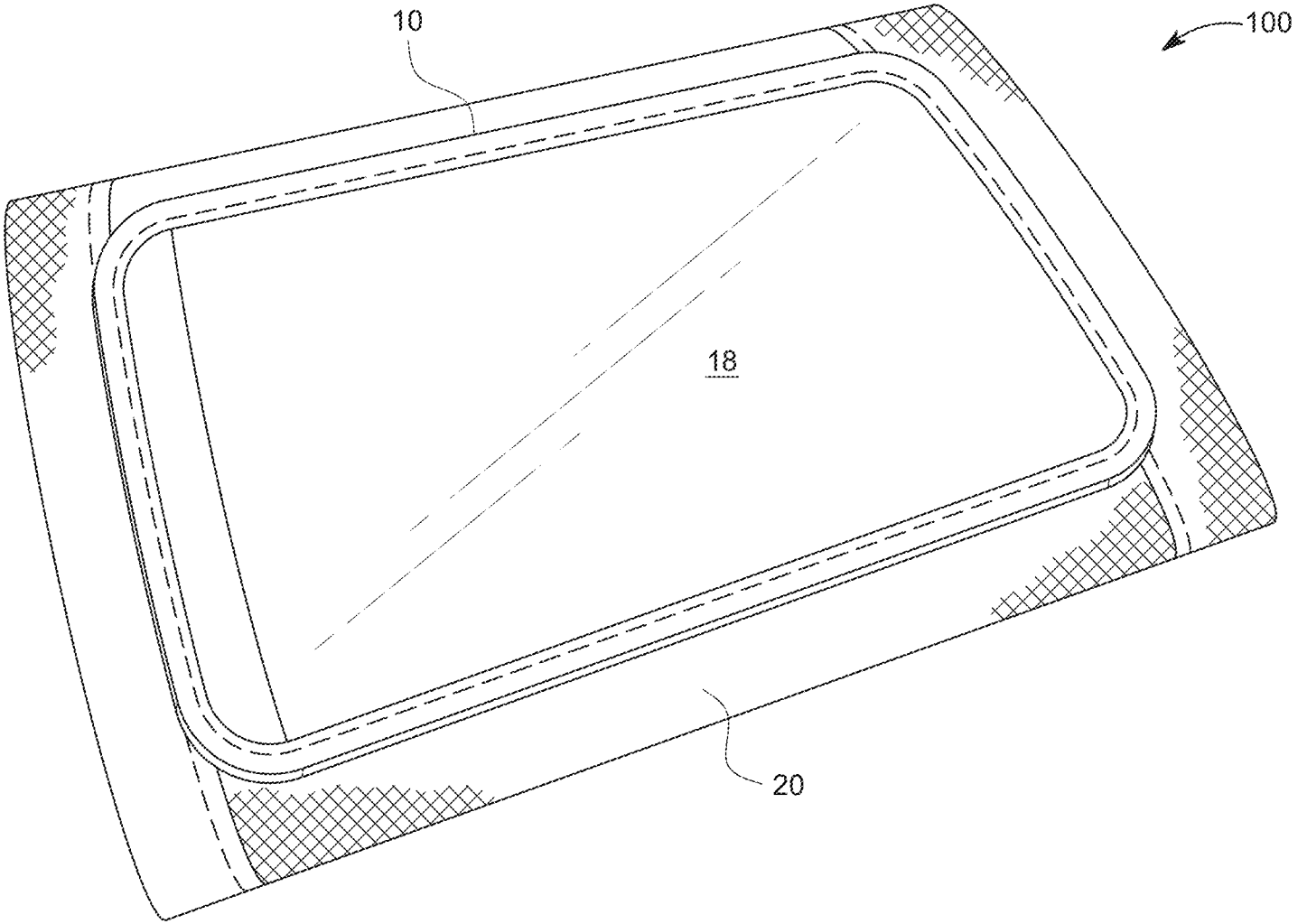
FIG. 3 is a top perspective view of an exemplary embodiment of the present invention, shown with the clear insert display portion and the wristband portion in the attached condition, wherein the display connection area and the wristband connection area are operatively associated so that an upper surface of the clear insert is visible.

Referring now to FIGS. 1 through 3, the present invention may include a separable play-call wristband system 100 comprising an insert display portion 10 and a wristband portion 20 which are dimensioned and adapted to removable attach to each other. The insert display portion 10 may be a sleeve with one closed end 14 and an opposing open end 16 for slidably received or sheathing one or more inserts. At least one surface of the insert display portion 10 is transparent so that the insert is visible when sheathed in the insert display portion 10. The remaining surface of the insert display portion 10 may be non-transparent. The wristband portion 20 may be a sleeve with two open ends for slidably received a hand and forearm through.

The insert display portion 10 may provide an upper surface 18 that is substantially transparent, thereby providing a window into the sheathed insert. The opposing lower surface 19 of the insert display portion 10 provides one or more display connectors 12. The wristband portion 20 provides one or more wristband connectors 22, wherein the display and wristband connectors 12 and 22 are dimensioned, adapted, sized and configured to removable attach to each other, forming the attached condition. Likewise, the display and wristband connectors 12 and 22 are configured so that the insert display portion 10 and the wristband portion 20 can each be moved to a separated condition. The separated condition would allow the insert display portion 10 to be moved to another wristband portion 20, thereby enabling the wristband portion 20 to be washed separate from the insert display portion 10.

Figure 4:
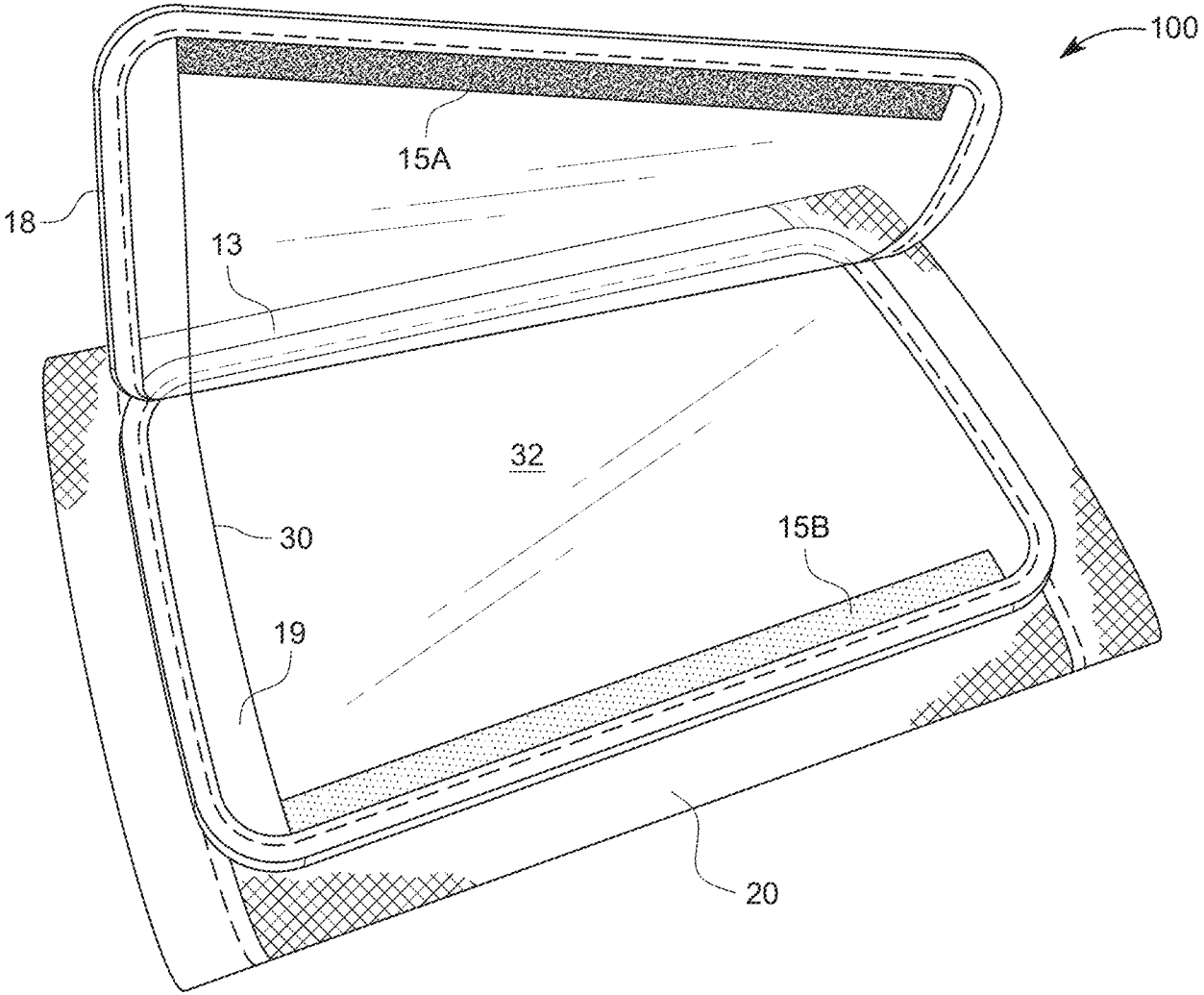
FIG. 4 is a top perspective view of an exemplary embodiment of the present invention.

Referring to FIG. 4, the insert display portion 10 may have an alternative configuration, where only one of its four edges are joined so that the upper surface 18 can pivot away from the lower surface 19, relative that joined edge 13, much like a page of a book is movably relative to an adjacent page. As a result, there is need to slidably insert the insert between the upper and lower surfaces 18 and 19. Complementary fasteners 15A and 15B may be present along, say, an edge opposing the joined edge 13, so that when the upper surface 19 is moved to sandwich the insert, the upper and lower surfaces are removable connected. Accordingly, in this embodiment, there is no closed end 14 and an opposing open end 16 with two closed/joined side/longitudinal edges, as only one longitudinal edge is joined (joined edge 13) while the other ends/edges are not joined.

The lower surface 19 may provide a transparent pocket 32 accessible by way of a pocket opening 30 for enabling a user to slide an insert into the pocket 32, thereby providing two methods of retaining, possibly differently valued inserts, between the upper and lower surfaces 18 and 19—i.e., (a) inserted into the pocket 32 and (b) outside the pocket 32 but otherwise retained by the upper surface 18 being closed over the lower surface 19 and secured by the complementary fasteners 15A and 15B. Note, the upper surface 18 may also have a pocket with an opening, as shown in FIG. 4.

The first and second connectors 12 and 22 may be male and female buttons or any type of removable fastener (e.g., hook and loop fasteners, adhesives, zippers, etc.) that can removably connect one object to another so that the invention functions are herein disclosed.

Accordingly, the separable play-call wristband system 100 can be used by athletes to keep track of play calls from their coach, with the above-mentioned advantages. Play-call wristbands are commonly used in tackle and flag football but can be used in any sport that could benefit from a cheat sheet for relaying and quickly comprehending play calls. And, unlike current play-call wristbands, a user would not have to wash the entire wristband and time-consumingly remove all the play-call sheets in the clear insert display.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A wristband play-call system comprising:

a wristband having one or more wristband connection points along an external surface of the wristband; and an insert display having a transparent layer and a connection layer, wherein the transparent layer and the connection layer are joined to define a space for receiving and retaining an insert between the transparent layer and the connection layer whereby play-call indicia provided by the insert is visible through the transparent layer, wherein the connection layer has a one or more display connection points configured to removably connect with the one or more wristband connection points, wherein the transparent layer and the connection layer are substantially coextensive and align when joined, and wherein the transparent layer and the connection layer are pivotable joined along a shared edge so that the transparent layer is movable between an open position for receiving the insert and a closed position for retaining the insert.

2. The wristband play-call system of claim 1, wherein the connection layer has a first surface facing the transparent layer and a second surface facing away from the transparent layer, and the one or more display connection points are only on the second surface.

3. The wristband play-call system of claim 2, wherein the wristband is a sleeve having an external surface comprising a first half and a second half.

4. The wristband play-call system of claim 3, wherein the one or more wristband connection points is a singular wristband connection area that covers at least three-fourths of the first half of the external surface.

5. The wristband play-call system of claim 4, wherein the one or more display connection points is a singular display connection area substantially coextensive with the singular wristband connection area.

6. The wristband play-call system of claim 5, further comprising complementary fasteners on the transparent layer and the connection layer that are dimensioned and disposed to form a locked engagement in the closed position.

7. The wristband play-call system of claim 6, further comprising a connection pocket and associated pocket opening along the first surface of the connection layer.

8. The wristband play-call system of claim 7, further comprising a transparent pocket and associated pocket opening along an inward surface of the transparent layer.

9. The wristband play-call system of claim 1, wherein the connection layer has a first surface facing the transparent layer and a second surface facing away from the transparent layer, and one or more display connection points are only on the second surface.

10. The wristband play-call system of claim 9, wherein the wristband is a sleeve having an external surface comprising a first half and a second half.

11. The wristband play-call system of claim 10, wherein the one or more wristband connection points is a singular wristband connection area that covers at least three-fourths of the first half of the external surface.

12. The wristband play-call system of claim 11, wherein the one or more display connection points is a singular display connection area substantially coextensive with the singular wristband connection area.

13. The wristband play-call system of claim 12, wherein the one or more display connection points and the one or more wristband connection points are hook and loop fasteners.

14. The wristband play-call system of claim 12, wherein the one or more display connection points and the one or more wristband connection points are snaps.

* * * * *